US009409749B2

(12) United States Patent
Kalliomäki

(10) Patent No.: US 9,409,749 B2
(45) Date of Patent: Aug. 9, 2016

(54) COMPENSATION DEVICE AND ELEVATOR

(71) Applicant: KONE Corporation, Helsinki (FI)

(72) Inventor: Jaakko Kalliomäki, Vantaa (FI)

(73) Assignee: KONE CORPORATION, Helsinki (FI)

( * ) Notice: Subject to any disclaimer, the term of this patent is extended or adjusted under 35 U.S.C. 154(b) by 299 days.

(21) Appl. No.: 13/734,387

(22) Filed: Jan. 4, 2013

(65) Prior Publication Data

US 2013/0118840 A1 May 16, 2013

Related U.S. Application Data

(63) Continuation of application No. PCT/EP2010/059591, filed on Jul. 5, 2010.

(51) Int. Cl.

| | |
|---|---|
| ***B66F 7/06*** | (2006.01) |
| ***B66F 3/22*** | (2006.01) |
| ***B66B 7/10*** | (2006.01) |
| ***B66B 7/06*** | (2006.01) |

(52) U.S. Cl.

CPC . *B66B 7/10* (2013.01); *B66B 7/068* (2013.01); *B66F 7/0658* (2013.01)

(58) Field of Classification Search

CPC ..... B66B 7/06; B66B 7/10; B66F 7/065; B66F 7/0658; B66F 3/22; B66F 11/042

USPC ..... 187/249, 264, 412, 404, 411; 254/122

See application file for complete search history.

(56) References Cited

U.S. PATENT DOCUMENTS

| | | | | |
|---|---|---|---|---|
| 2,537,075 A | | 1/1951 | Margles | |
| 3,653,467 A | | 4/1972 | Showalter | |
| 4,522,285 A | | 6/1985 | Salmon et al. | |
| 5,277,276 A | | 1/1994 | Pramanik et al. | |
| 5,694,864 A | * | 12/1997 | Langewellpott | 108/145 |
| 5,788,018 A | * | 8/1998 | Mendelsohn et al. | 187/404 |
| 5,934,414 A | * | 8/1999 | Staczek | 187/269 |
| 5,993,146 A | * | 11/1999 | Hallgren | 414/792.2 |
| 6,431,321 B2 | * | 8/2002 | Ach | 187/264 |
| 6,742,768 B2 | * | 6/2004 | Alba | B66F 7/065 187/211 |

(Continued)

FOREIGN PATENT DOCUMENTS

| | | | | |
|---|---|---|---|---|
| CA | 2278186 A1 | * | 7/1998 | B66F 9/08 |
| EP | 501254 A2 | * | 9/1992 | B66F 7/06 |

(Continued)

*Primary Examiner* — William A Rivera

*Assistant Examiner* — Stefan Kruer

(74) *Attorney, Agent, or Firm* — Birch, Stewart, Kolasch & Birch, LLP

(57) ABSTRACT

A compensation device of a traction sheave elevator is provided. The elevator includes a compensation rope running from an elevator car to a compensation sheave of the compensation device located in the lowermost part of the elevator shaft around which the compensation rope runs. The compensation sheave is vertically guided with respect to the shaft bottom via a guiding structure, which allows a vertical movement of the axis of the compensation sheave. The guiding structure includes at least one scissor joint arrangement having its lower end adapted to be connected with an elevator shaft bottom and its upper end being connected with the compensation sheave axis. An elevator includes such kind of compensation device. Vertical movement of the axis of a compensation sheave can be obtained with a very low shaft height requirement.

20 Claims, 4 Drawing Sheets

(56) References Cited

U.S. PATENT DOCUMENTS

Figure 1:
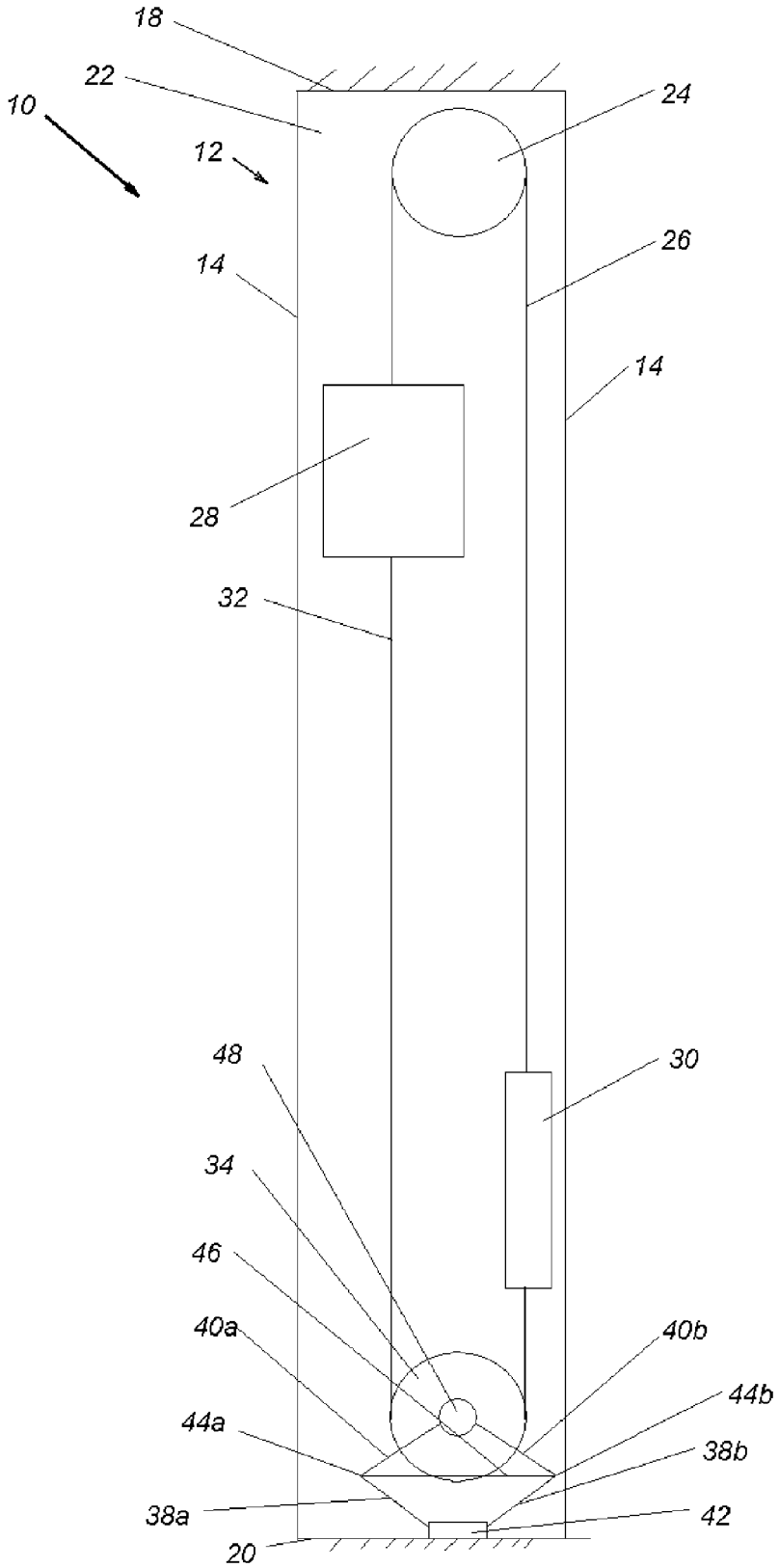

| | | | | |
|---|---|---|---|---|
| 7,213,686 | B2 * | 5/2007 | Kaufman | 187/262 |
| 7,413,056 | B2 * | 8/2008 | Gonzi et al. | 187/269 |
| 2005/0217941 | A1 * | 10/2005 | Strebel et al. | 187/249 |

FOREIGN PATENT DOCUMENTS

| | | | | |
|---|---|---|---|---|
| GB | 1556624 | A * | 11/1979 | B66F 3/22 |
| JP | 07267594 | A * | 10/1995 | B66F 7/06 |
| JP | 2000007249 | A * | 1/2000 | B66B 7/10 |

* cited by examiner

COMPENSATION DEVICE AND ELEVATOR

CROSS REFERENCE TO RELATED APPLICATIONS

This non-provisional application is a Continuation of International Application No. PCT/EP2010/059591 filed on Jul. 5, 2010. The entire content of the above application is hereby incorporated by reference.

The invention relates to a compensation device with a compensation rope to compensate the weight of the suspension rope in high rise traction sheave elevators. Compensation devices in fast elevators have two tasks. The first task is to compensate the weight of the suspension ropes in case of very large hoisting heights, particularly when the car approaching the upper most or lower most car position. The compensation rope builds together with the suspension rope a closed rope sling. Accordingly the rope weight is no longer dependant on the position of the elevator car. Further, the compensation rope prevents the elevator car from a free upwards movement in case the gripping device on a counterweight grips or the counterweight hits the upper buffers. To keep the tension in the ropes steady the compensation device has to have a compensation sheave with an axis that can adjust in the vertical direction freely so as to meets changing rope length due to temperature and humidity changes and wire etc.

Usually, the compensation devices comprise in the lower most part of the elevator shaft a compensation sheave around which the compensation rope runs. The axis of the compensation sheave is supported in a vertically movable manner to cope with changes in the rope length caused by environmental circumstances and wear. The compensation device usually comprises a lockdown device for limiting the upper range of the vertical movement of the compensation sheave.

In a well known solution a vertical frame is used for the guidance of the compensation sheave axis along a vertical path to meet changes of the rope length. Anyway, this known frame consumes a considerable vertical space in the shaft pit. This limits the elevator layout particularly in cases where the shaft pit is considerably low so that the guide frame of the compensation device sets limitations for the elevator layout.

Furthermore, the U.S. Pat. No. 4,522,285 discloses a support for the compensation sheave comprising a hydraulic device with a vertical hydraulic cylinder. Also this device takes up a considerable vertical height which again limits the options for the elevator layout.

It is therefore aim of the present invention to provide a compensation device allowing the vertical movement of the compensation sheave which does not hamper elevator layouts and can be used in elevators having a comparably low shaft pit.

The target of the invention is solved with a compensation device according to claim 1 as well as with an elevator according to claim 10. Advantageous embodiments of the invention are subject matter of the sub-claims.

According to the invention the compensation device comprises a scissor joint (or scissor jack) arrangement which allows a vertical adjustment of the axis of the compensation sheave according to rope elongation or dynamic forces acting in the elevator. On the other hand the scissor joint or scissor jack arrangement necessitates only a very small vertical space so that the vertical adjustment of the compensation sheave axis is also possible in very low shaft pits.

On that behalf the lower end of the scissor joint arrangement is connected with the elevator shaft bottom or with any structure of the elevator in the lowermost part of the shaft. The connection with the elevator shaft bottom may be direct but can be realized via any support structure which is connected to the elevator shaft in the lower most part of the elevator shaft, e.g. connected to guide rails, buffers, separate mounting structures, the shaft bottom or the shaft wall.

A basic advantage of the scissor joint arrangement is that the same design of the scissor joint can be used to cover a large rope stretch range also having a very low installation height.

The upper end of the scissor joint arrangement carries the axis of the compensation sheave. Via this arrangement the axis of the compensation sheave is rigidly guided on a vertical path without necessitating considerable shaft height.

Preferably by the upper end of the scissor joint arrangement also a tension weight is supported whereby the tension weight may also be integrated in the compensation sheave. The tension weights impose a weight to the axis of the compensation sheave as to tension the compensation ropes as well as the suspension ropes.

A scissor joint provides an immanent upper limit to range of, when the arms of the scissor joint turn into their vertical position at its uppermost extended position. In this case the distance of the compensation sheave axis from the shaft bottom is at a maximum. As a further upwards movement of the compensation sheave axis is no longer possible the scissor joint also acts as lockdown device.

A very simple construction of a scissor joint arrangement is obtained if the scissor joint arrangement comprises two first arms which are articulated to a base part fixed with respect to the shaft bottom and if the scissor joint arrangement comprises two second arms which are articulated to the first arms via pivots. With this arrangement the scissor joint arrangement only needs four arms to guide the compensation sheave on a mounting support connected with the second arms, preferably with the upper ends thereof.

Advantageously the second arms comprise two spaced apart arm sections which are pivoted at their upper ends to a mounting support for the compensation sheave axle, whereby between arm sections a gap b is provided which is larger than the thickness d of the compensation sheave. By this measure the compensation sheave can extend within the height of the scissor joint arrangement so that it does not need to be located completely below the compensation sheave. Accordingly the height of this arrangement including the compensation sheave is very low.

Preferably, the pivot axes of the scissor joint arrangement are coaxial to the compensating sheave axis. By this arrangement a space saving solution is obtained although it is also possible to arrange the pivots of the scissor joint perpendicular to the compensation sheave.

Preferably, the first arms have in axial direction of the compensation sheave a larger width a than the thickness d of the compensation sheave. By this means a rigid vertical guide for the compensation sheave axis is provided whereby the width of the scissor joint arms extends parallel to the compensation sheave axis. Via this construction it is possible that the axis of the compensation sheave is gripped by scissor joint arrangement on both sides. Accordingly, the scissor joint arrangement only needs two first arms and two second arms articulated with each other to support the compensation sheave axis on both ends. Thus the structure is very rigid and simple in its construction. Further this arrangement has a very low height as the compensation sheave extends into the region of the arms of the scissor joint arrangement.

Preferably, the scissor joint arrangement comprises at least one horizontal lockdown device located between arms of the scissor joint arrangement, which lockdown device limits the maximal range of vertical movement of the scissor joint arrangement. This provides a more defined kind of upper limitation. Preferably, the lockdown device is connected between the pivots at the connection point of the first and second arms of the scissor joint. This lockdown device is preferably a length adjustable arrangement with a stopper for the minimal length. Such device can for example be a telescopic device as e.g. a hydraulic cylinder. When the compensation sheave is pulled in upwards direction, e.g. because of any dynamic situations in the elevator, the first and second arms of the scissor joint tend to straighten up in a vertical position. Thereby the mutual distance of both joints which are arranged between the first and second arms of the scissor joint is decreasing. Preferably, between these joints the lockdown device is arranged. The lockdown device has a stopper for an allowable minimal distance of the joints. When this minimal distance is reached by a pull on the compensation sheave via the compensation ropes the stopper of the lockdown device comes into action and the mutual distance of the joints between the first and second arms of the scissor joint can't be further reduced. This also limits the maximal distance between the upper and lower ends of the scissor joint and therefore the maximal allowable distance of the compensation sheave from the shaft bottom.

Preferably, the lockdown device comprises a buffer as stopper for the movement range limits. This enables a smooth approach to the limits of the vertical guide way of the scissor joint arrangement.

In a simple and reliable embodiment the lockdown device is a hydraulic or pneumatic damper element. Thus, the lockdown device has some dampening effect to reduce any vibrations or dynamic movements of the compensation sheave.

Preferably the lockdown device is a hydraulic or pneumatic cylinder having a first chamber and a second chamber between which a piston is movable. Such a cylinder allows an easy setting of both limits for the movement range as well as the dampening characteristics of the cylinder. A cylinder is further able to cover a large vertical play of the compensation sheave axis without necessitating a considerable height as of its horizontal location.

If in a further preferred embodiment at least the first chamber of the cylinder is connected via a controllable pressure pump to a fluid storage the lockdown device can be used to push the axis of the compensation sheave to the top thereby reducing or eliminating the tension on the compensation ropes. By this way it is easy to perform any installation or maintenance work. By this means it is further possible that the compensation sheave is lifted of its normal operational limit. By this way an initial stretch of the ropes can be taken away without reducing the tension in operation after commissioning. This feature may be adapted to reduce the need to shorten the ropes.

Advantageously also a tension weight is fixed together with the compensation sheave axis to the upper end of the scissor joint arrangement. This enables a tensioning of the compensation ropes and suspension ropes vi the compensation sheave.

The scissor joint arrangement may comprise more than one, e.g. two separated or connected scissor joints (or scissor jacks), whereby these two scissor joints are located at both ends of the compensation sheave. Hereby one scissor joint is used for each end of the compensation sheave, respectively. By this measure very simple scissor joint constructions may be used which do not need any adaption to the compensation sheave.

Furthermore, it is self-evident that the scissor joint not only needs a first and a second arm but also may have third and forth arms if a larger vertical guide way is to be achieved. In this case these arms are mutually articulated as it is per se known from scissor joints or scissor jacks.

As lockdown device or additionally to the lockdown device a drive means as e.g. a hydraulic cylinder or a rack and pinion drive may be located between the first and/or second arms of the scissor joint so as to be able to lift up the compensation sheave and eventually the tension weights without using any man power.

Although, the compensation device according to the invention is preferably configured to be used in large elevators or elevators with a large lifting height, or in fast elevators, preferably in elevators with a velocity above 3.5 m/s, it may also be used in slower elevators. Anyway, use of a compensation device in traction sheave elevators according to the invention is particularly characteristic for fast elevators.

The compensation device can be used in elevators with and without counter-weight.

The invention also refers to an elevator comprising a compensation device as mentioned above.

It is evident for the skilled person that the above mentioned features of the invention and features of preferred solutions may be combined arbitrarily as long as this is technically possible.

Figure 2:
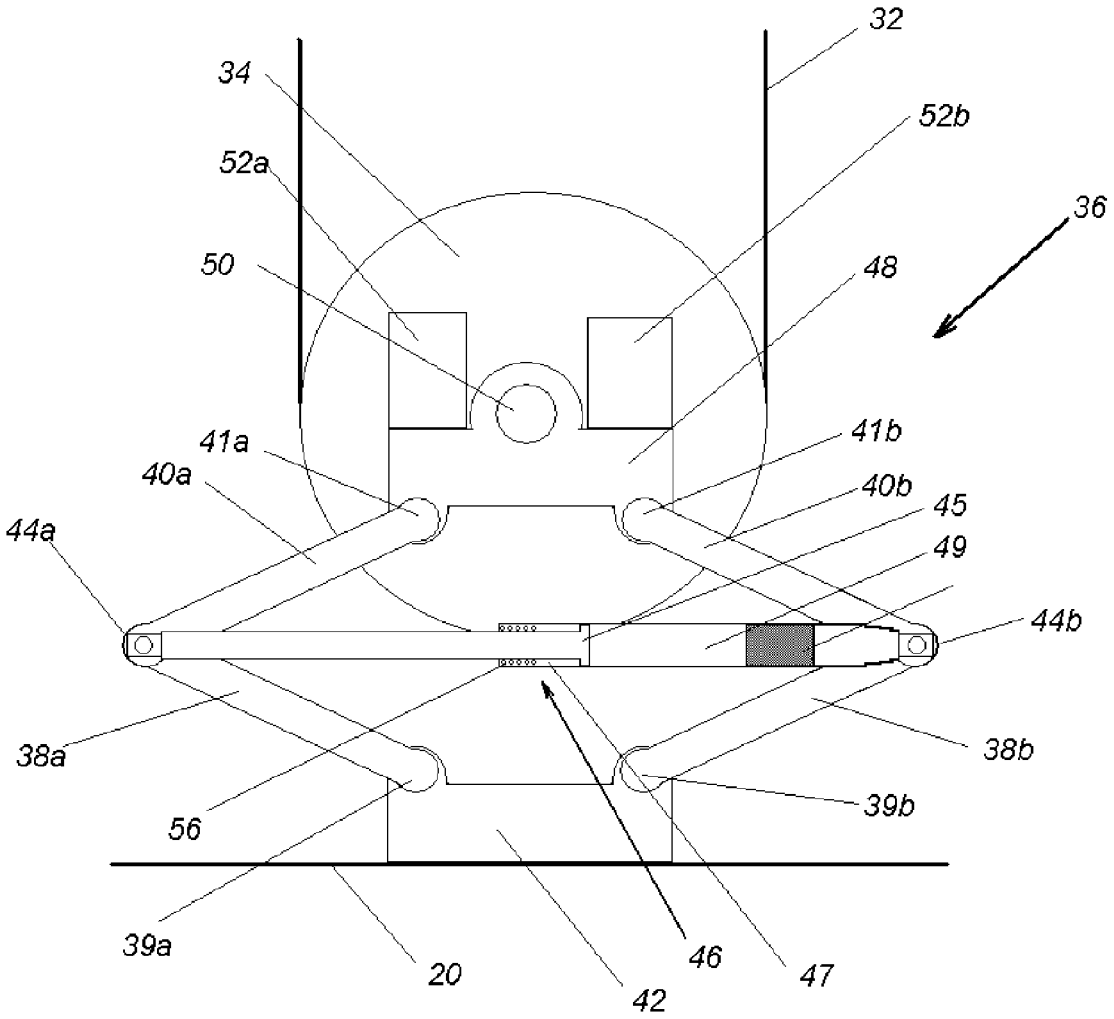
Figure 3:
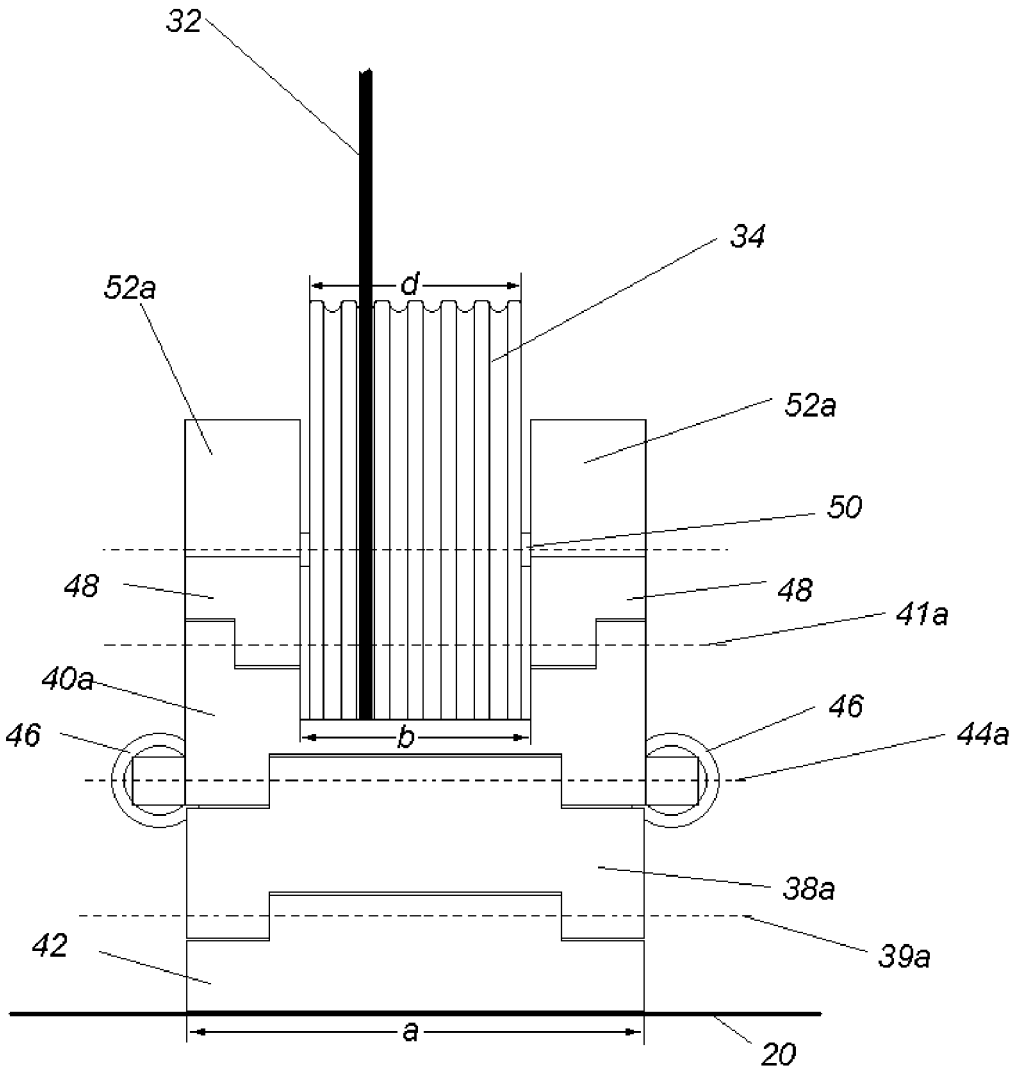

The invention is now described schematically by the aid of the attached drawings. These show in:

FIG. 1 a diagram showing an elevator with a compensation device comprising a scissor joint arrangement, FIG. 2 a more detailed front view of the scissor joint arrangement of FIG. 1, FIG. 3 a view direction III of FIG. 2, and FIGS. 4 to 6 different embodiments of scissor joint arrangements.

In the Figures below identical or functional identical parts are allotted the same reference numbers.

The elevator 10 of the invention comprises an elevator shaft 12 with shaft walls 14, a shaft ceiling 18 as well as a shaft bottom 20. In the upper part of the elevator shaft 12 a room 22 is provided for the drive machine which room can be separated from the lower part of the elevator shaft where the car and the counterweight moves or can be integrated in the elevator shaft. The drive machine (not visible) drives a traction sheave 24 which grips on its circumference hoisting ropes 26, which hoisting ropes may be ropes with circular cross sections, belts or chains. Usually, at least two separate parallel ropes are used. The suspension rope 26 is connected to an elevator car 28 and a counterweight 30. A compensation rope 32 runs down from the elevator car 28 to a compensation sheave 34. The compensation rope 32 is passed around the circumference of the traction sheave 34 and runs up to a fixing point underneath the counterweight 30. The compensation sheave 34 is connected to the shaft bottom 20 via a scissor joint arrangement 36 having first arms 38*a*, 38*b* and second arms 40*a*, 40*b*. The first arms 38*a*, 38*b* are pivotally connected to a base part 42 connected with the shaft bottom 20. The upper ends of the first arms 38*a*, 38*b* are pivotally connected to the lower end of the second arms 40*a*, 40*b* at the pivots 44*a*, 44*b*. A lockdown device 46 is horizontally arranged between the pivots 44*a*, 44*b* to limit the movement range of the scissor joint arrangement 36. The upper end of the second arms 40*a*, 40*b* are pivotally connected to a mounting support 48 for the axis 50 of the compensation sheave 34.

The structure and function of the scissor joint arrangement 36 becomes clear from the detailed front view of FIG. 2.

FIG. 2 shows the pivotal connection of the first arms 38*a*, 38*b* to the base part 42 via lower pivots 39*a*, 39*b* as well as the pivotal connection of the upper ends of the second arms 40*a*, 40*b* to the mounting support 48 via upper pivots 41*a*, 41*b*.

The mounting support 48 carries the axis 50 of the compensation sheave 34 as well as tension weights 52*a, b* which are used to keep the compensation rope 32 under tension. Via this scissor joint arrangement 36 an exact vertical guidance of the axis 50 of the compensation sheave 34 is obtained thereby meeting a length change of the ropes in response to temperature changes or environmental or dynamical situations acting on the ropes.

The lockdown device 46 is a hydraulic cylinder with a first chamber 47 which may be connected via a pressure pump with a hydraulic storage (not shown) so as to move the compensation sheave upwards via action of the pressure pump. This solution facilitates installation and maintenance and any work in connection with rope changes or rope maintenance.

Further, the lockdown device 46 comprises a bumper 54 which is hit by a piston 45 of the lockdown device if the minimal allowed distance between the pivots 44*a* and 44*b* is obtained which corresponds to the uppermost allowable position of the compensation sheave 34.

On the other side in the lockdown device 46 a bumper spring 56 is provided which is hit by the backside of the piston 45 if the compensation sheave comes to its allowable lower most position, e.g. if the ropes a detached from the compensation rope sheave. Advantageously, the bumper spring 56 as well as the bumper 54 are axially adjustable e.g. by adjustment nuts running on a axial thread of the lockdown device, thereby allowing the limits of the moving range to be adjusted. The bumper spring 56 guarantees smooth approach of the lower most position of the compensation sheave. The room between those bumpers 54 and 56 may be filled with a gas or liquid whereby the piston 45 may comprise perforations to allow a well defined gas or hydraulic flow from the first chamber 47 to the second chamber 49 of the lockdown device 46. In this case the lockdown device is provided as hydraulic or pneumatic cylinder.

FIG. 3 shows that two parallel lockdown devices 46 are provided at each end of the compensation sheave 34. FIG. 3 further shows that the width a) of the first and second arms 38*a* and 40*a* of the scissor joint arrangement 36 is larger than the thickness d) of the compensation sheave 34 which allows that the axis 50 of the compensation sheaves grip securely by the mounting supports 48 at the upper end of the second arms 40*a*.

Further, the second arm 40*a* comprises a gap with a width b in its upper edge, so as to take up the compensation sheave 34. Accordingly the width b of the gap is slightly larger than the width d of the compensation sheave 34. By this means the height of the scissor joint arrangement can be further reduced.

Instead of a one part scissor joint arrangement also two separate scissor joints may be arranged at both ends of the compensation sheave 34.

Figure 4:
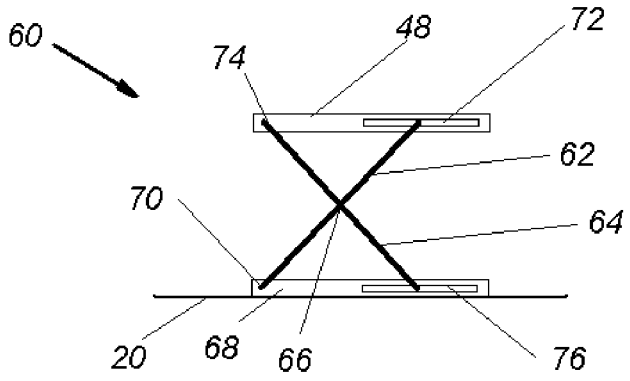

FIG. 4 shows another embodiment of a scissor joint arrangement 60 comprising two arms 62, 64 which are connected in their middle via an hinge 66. The first arm 62 is connected to a base plate 68 via a lower joint 70 and the upper end of the first arm 62 is slidably supported in a long slot 72 of the mounting support 48. The base plate 68 is connected to the floor 20 of the elevator shaft. The second arm 64 is connected with its upper end via an upper joint 74 to the mounting support 48 and with its lower end to a long slot 76 of the base plate 68. The mounting support can be configured according to the mounting support 48 of FIGS. 1 to 3 to guide the axis 50 of the compensation sheave 34. Also this scissor joint arrangement 60 allows a vertical guidance of the axis 50 of the compensation sheave 34. Between the upper ends of the first and second arm 62 and 64 are between the lower ends thereof a hydraulic cylinder, e.g. the hydraulic cylinder 46 of FIGS. 1 to 3, can be placed as a dampening means and/or as lockdown device or even as a drive means if it is connected with a pressure pump and a fluid storage to move the compensation sheave 34 together with the tension weights 52*a*, 52*b* upwards.

Figure 5:
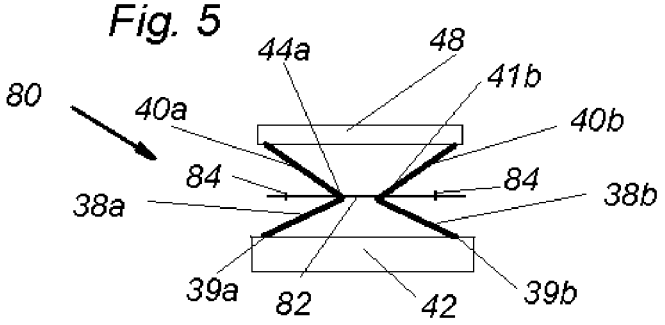

FIG. 5 shows a scissor jack arrangement 80 which is nearly identical to the scissor jack arrangements of FIGS. 1, 2, 3 with the exception that the first 38*a, b* and second arms 40*a, b* of the scissor joint arrangement are facing to each other and are not tilted from each other as in FIGS. 1 to 3. In this case the lockdown device is preferably a bar 82 comprising stoppers 84 to limit the maximum distance of the pivots 44 and accordingly the uppermost position of the compensation sheave 34.

Figure 6:
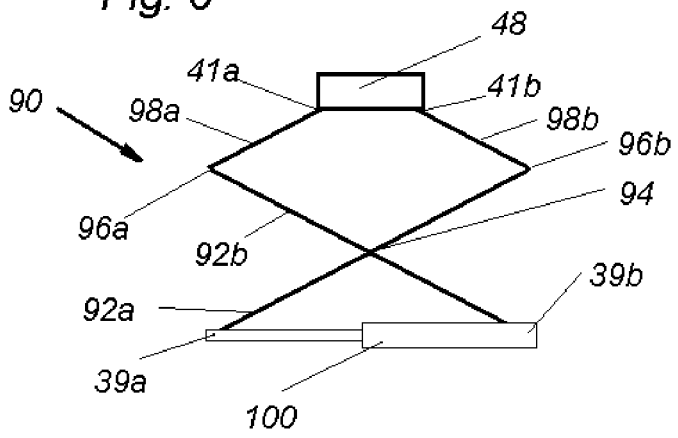

FIG. 6 shows a further embodiment 90 of a scissor joint which is provided for very long vertical adjustments. The scissor joint arrangement 90 comprises two first arms 92*a* and 92*b* which are connected by a pivot 94. The upper ends of the first arms 92*a*, 92*b* are connected via second pivots 96*a*, 96*b* to second arms 98*a*, 98 *b* which are again connected via pure pivots 41*a*, 41*b* to the mounting support 48 for the traction sheave and the tension weights. The lower ends of the first arms 92*a*, 92*b* are connected via lower pivots 39*a*, 39*b* to a hydraulic cylinder 100 which acts as a dampener as well as a lockdown device. This hydraulic cylinder is fixedly mounted to the lower most part of the elevator shaft.

The invention is not delimited by the above-mentioned embodiment but may be vary within the scope of the appended claims.

Single features of the above embodiments may be combined with each other arbitrarily as long as this is not excluded by contradictions. Accordingly the lockdown devices shown in connection with certain embodiments (FIGS. 1 to 6) could also be used in the other embodiments of scissor joint arrangements as shown in the figures.

The invention claimed is:

1. A compensation device of a traction sheave elevator, which elevator comprises a compensation rope running from an elevator car to a compensation sheave of the compensation device located in an elevator shaft bottom around which the compensation rope runs, whereby the compensation sheave is vertically guided with respect to the elevator shaft bottom via a guiding structure which allows a vertical movement of an axis of the compensation sheave, wherein the guiding structure comprises at least one scissor joint arrangement having its lower end adapted to be connected with the elevator shaft bottom and its upper end being connected with the compensation sheave axis, wherein the scissor joint arrangement comprises a pair of first arms, a pair of second arms, and at least one horizontal lockdown device, both one of the first arms and one of the second arms pivot at a first pivot, and both the other one of the first arms and the other one of the second arms pivot at a second pivot, the at least one horizontal lockdown device having a first end located at the first pivot, and a second end located at the second pivot, the at least one lockdown device limiting a maximal range of vertical movement of the upper end of the scissor joint arrangement, a total length of the at least one horizontal lockdown device between the first end and the second end changing during the vertical movement of the upper end of the scissor joint arrangement, the total length of the at least one horizontal lockdown device between the first end and the second end being a total length of an entirety of the at least one horizontal lockdown device in a direction from the first end to the second end and changing during the vertical movement of the upper end of the scissor joint arrangement.

2. The compensation device according to claim 1, wherein the pair of first arms is articulated to a base part fixed with respect to the elevator shaft bottom.

3. The compensation device according to claim 2, wherein the pair of second arms is articulated to the pair of first arms via the first pivot and the second pivot.

4. The compensation device according to claim 3, wherein the pair of second arms comprises two spaced apart arm sections which are pivoted at their upper ends to a mounting support for the axis of the compensation sheave, whereby between arm sections a gap is provided which is larger than a thickness of the compensation sheave.

5. The compensation device according to claim 4, wherein the pivot axes of the scissor joint arrangement are coaxial or perpendicular to the compensating sheave axis.

6. The compensation device according to claim 4, wherein the pair of first arms has in an axial direction of the compensation sheave a larger width than a thickness of the compensation sheave.

7. The compensation device according to claim 3, wherein the pivot axes of the scissor joint arrangement are coaxial or perpendicular to the compensating sheave axis.

8. The compensation device according to claim 3, wherein the pair of first arms has in an axial direction of the compensation sheave a larger width than a thickness of the compensation sheave.

9. The compensation device according to claim 2, wherein the pivot axes of the scissor joint arrangement are coaxial or perpendicular to the axis of the compensation sheave.

10. The compensation device according to claim 9, wherein the pair of first arms has in an axial direction of the compensation sheave a larger width than a thickness of the compensation sheave.

11. The compensation device according to claim 2, wherein the pair of first arms has in an axial direction of the compensation sheave a larger width than a thickness of the compensation sheave.

12. The compensating device according to claim 1, wherein the lockdown device is a hydraulic or pneumatic cylinder having a first chamber and a second chamber between which a piston is movable.

13. The compensating device according to claim 12, wherein at least the first chamber of the cylinder is connected via a pressure pump to a fluid storage.

14. An elevator comprising at least one elevator car, a suspension rope on which the elevator car is suspended, a drive machine comprising a traction sheave gripping the suspension rope to move the elevator car, and a compensation device according to claim 1.

15. The elevator according to claim 14, further comprises a counterweight which is suspended on the suspension rope, and that the compensation rope runs between the car and the counterweight to the lower part of the elevator shaft via the compensation sheave.

16. The compensation device according to claim 1, wherein the lockdown device comprises a buffer.

17. The compensation device according to claim 1, wherein a tension weight is fixed to the upper end of the scissor joint arrangement.

18. The compensation device according to claim 1, wherein the scissor joint arrangement comprises two scissor joints, which are located on a mounting support for the compensation sheave.

19. The compensation device according to claim 1, wherein the total length of the at least one horizontal lockdown device between the first end and the second end and the total length of an entirety of the at least one horizontal lockdown device in the direction from the first end to the second end decrease during the vertical movement of the upper end of the scissor joint arrangement in an upward direction, and increase during the vertical movement of the upper end of the scissor joint arrangement in a downward direction.

20. A compensation device of a traction sheave elevator, which elevator comprises a compensation rope running from an elevator car to a compensation sheave of the compensation device located in an elevator shaft bottom around which the compensation rope runs, whereby the compensation sheave is vertically guided with respect to the elevator shaft bottom via a guiding structure which allows a vertical movement of an axis of the compensation sheave, wherein the guiding structure comprises at least one scissor joint arrangement having its lower end adapted to be connected with the elevator shaft bottom and its upper end being connected with the compensation sheave axis, wherein the scissor joint arrangement comprises a pair of first arms, a pair of second arms, and at least one horizontal lockdown device, both one of the first arms and one of the second arms pivot at a first pivot, and both the other one of the first arms and the other one of the second arms pivot at a second pivot, the at least one horizontal lockdown device having a first end located at the first pivot, and a second end located at the second pivot, the at least one lockdown device limiting a maximal range of vertical movement of an upper end of the scissor joint arrangement, a total length of the at least one horizontal lockdown device between the first end and the second end changing during the vertical movement of the upper end of the scissor joint arrangement, and wherein the at least one horizontal lockdown device is a hydraulic or pneumatic damper element.

* * * * *